US007883174B2

(12) United States Patent
Wheeler

(10) Patent No.: US 7,883,174 B2
(45) Date of Patent: Feb. 8, 2011

(54) COVER FOR FLUID JETTING DEVICE AND METHOD FOR ENHANCING FLUID PERFORMANCE

(75) Inventor: Davd M. Wheeler, Norwalk, CT (US)

(73) Assignee: Illinois Tool Works Inc., Glenview, IL (US)

( * ) Notice: Subject to any disclaimer, the term of this patent is extended or adjusted under 35 U.S.C. 154(b) by 873 days.

(21) Appl. No.: 11/673,975

(22) Filed: Feb. 12, 2007

(65) Prior Publication Data

US 2008/0192081 A1 Aug. 14, 2008

(51) Int. Cl.
*B41J 2/165* (2006.01)

(52) U.S. Cl. ..... 347/29

(58) Field of Classification Search ..... None
See application file for complete search history.

(56) References Cited

U.S. PATENT DOCUMENTS

| | | | | |
|---|---|---|---|---|
| 6,305,779 | B1 | 10/2001 | Capurso et al. | |
| 6,726,306 | B2 * | 4/2004 | Keyes et al. | 347/32 |
| 2003/0076376 | A1 * | 4/2003 | Greeven et al. | 347/29 |

FOREIGN PATENT DOCUMENTS

| | | |
|---|---|---|
| DE | 8205426 | 8/1986 |

OTHER PUBLICATIONS

International Search Report dated Jul. 11, 2008 for PCT/US2008/053534.

* cited by examiner

*Primary Examiner*—Manish S Shah
*Assistant Examiner*—Alexander C Witkowski
(74) *Attorney, Agent, or Firm*—Levenfeld Pearlstein, LLC

(57) ABSTRACT

A cover is configured for use with a fluid jet device having a surface defining a plurality of orifices formed therein through which a fluid is jetted. The cover includes a cover element movable parallel to the surface between a covered position in which the cover element overlies the orifices and an uncovered position in which the cover is moved to expose the orifices. The cover includes a mounting portion configured to maintain the cover spaced from the surface to define a vapor space region. At least one hinge element operably mounts the cover to the fluid jet device. The hinge element includes a first leg mounted at a free end to a stationary portion of the fluid jet device and a second leg mounted at a free end to the cover portion. The first and second legs are connected to one another by a flexible region such that movement of the legs slides the cover between the covered and exposed positions. The vapor space region maintains a level of fluid vapor concentration around the orifices to reduce the rate of evaporation of the fluid.

20 Claims, 3 Drawing Sheets

COVER FOR FLUID JETTING DEVICE AND METHOD FOR ENHANCING FLUID PERFORMANCE

BACKGROUND OF THE INVENTION

The present invention relates to fluid jet devices. More particularly, the present invention is directed to a cover for fluid jet device heads to reduce the maintenance of the head and to improve the performance of certain jetted fluids.

Fluid jet devices are in wide-spread use. One major application of fluid jet devices is in inkjet printheads. These print heads are in wide-scale use from large industrial/commercial settings to small individual and consumer products.

Inkjet technology can be categorized as drop-on-demand and continuous jetting. In drop-on-demand printing, ink is jetted from the printhead (from a series of orifices in the head) onto a substrate. The ink is jetted or ejected as droplets in a discrete pattern to form a desired pattern, such as lettering, designs or bar codes, on the substrate. In continuous inkjet technology, ink droplets are continuously jetted and are directed, by use of a field, such as an electro-magnetic field, along a specific trajectory, to a substrate (to print) or into a gutter to be discarded.

Drop-on-demand technology can be further categorized as thermal inkjet technology, piezoelectric technology and valve-based technology. All of these technologies have certain advantages. For example, thermal technology provides high resolution with relatively low cost. Piezoelectric technology offers high jetting frequency, long lifetime, and the ability to jet a wide range of fluids.

Drop-on-demand (DOD) printing, although widely used, does have its drawbacks. For example, it is difficult to use quick-drying inks with DOD printing. These inks begin to dry rapidly, and have been found to, at times, begin drying before being ejected from the printhead orifice. This can result in the printhead orifices becoming partially or fully clogged, which can ultimately result in equipment shut downs for maintenance, repair or replacement.

Accordingly, there is a need for a device for a fluid jet device, such as a printhead, that enhances the performance of the fluid jetted from the device. Desirably, such an enhancement includes extending the life of the fluid and the usable life of the jetting device. More desirably, such a device is used in-line and has minimal or no adverse impact on the use of the jetting device.

SUMMARY OF THE INVENTION

A cover for a fluid jet device having a surface defining at least one orifice formed therein through which a fluid is jetted includes a cover element movable parallel to the surface between a covered position in which the cover element overlies the at least one orifice and an uncovered position in which the cover is moved to expose the at least one orifice. The cover includes a mounting portion configured to maintain the cover spaced from the surface to define a vapor space region. A preferred jet device includes a plurality of orifices.

At least one hinge element operably mounts the cover to the fluid jet device. The hinge element includes a first leg mounted at a free end to a stationary portion of the fluid jet device and a second leg mounted at a free end to the cover portion. The first and second legs are connected to one another by a flexible region such that movement of the legs slides the cover between the covered and exposed positions.

The vapor space region maintains a level of fluid vapor concentration around the orifices to reduce the rate of evaporation of the fluid.

In one embodiment, the cover includes at least two hinge elements spaced from one another at about opposite ends of the cover element. The hinge element first leg has an extension portion that extends beyond the hinge flexible region to define a engaging portion. The cover can include fingers that depend from and extend inwardly of the cover element to maintain the cover on the faceplate and permit sliding the cover above (and parallel to) the faceplate.

A fluid jetting device especially for use with evaporative fluids includes a fluid jetting member having a faceplate defining a surface having a plurality of orifices therein through which the fluid is jetted and a movable cover for the fluid jetting member.

A method for maintaining a fluid in a fluidic or semi-fluidic state at an orifice of a fluid jetting device includes the steps of providing a fluid jet device having a plurality of orifices through which the fluid is jetted, providing a movable cover overlying the orifices, moving the cover to expose the orifices when fluid is being jetted from the orifices and moving the cover over the orifices when fluid is not being jetted from the orifices. The step of moving the cover can be effected by the movement of an object over the fluid jetting device in proximity to the cover.

These and other features and advantages of the present invention will be apparent from the following detailed description, in conjunction with the appended claims.

BRIEF DESCRIPTION OF THE DRAWINGS

The benefits and advantages of the present invention will become more readily apparent to those of ordinary skill in the relevant art after reviewing the following detailed description and accompanying drawings, wherein:

FIGS. 2A-C are graphic side view illustrations of a printhead in which FIG. 2A shows a conventional printhead with an automatic maintenance system, FIG. 2B shows a printhead with an automatic maintenance system and with the cover of the present invention, and FIG. 2C is an alternate embodiment showing a wrap-around cover configuration;

DETAILED DESCRIPTION OF THE INVENTION

Figure 1:
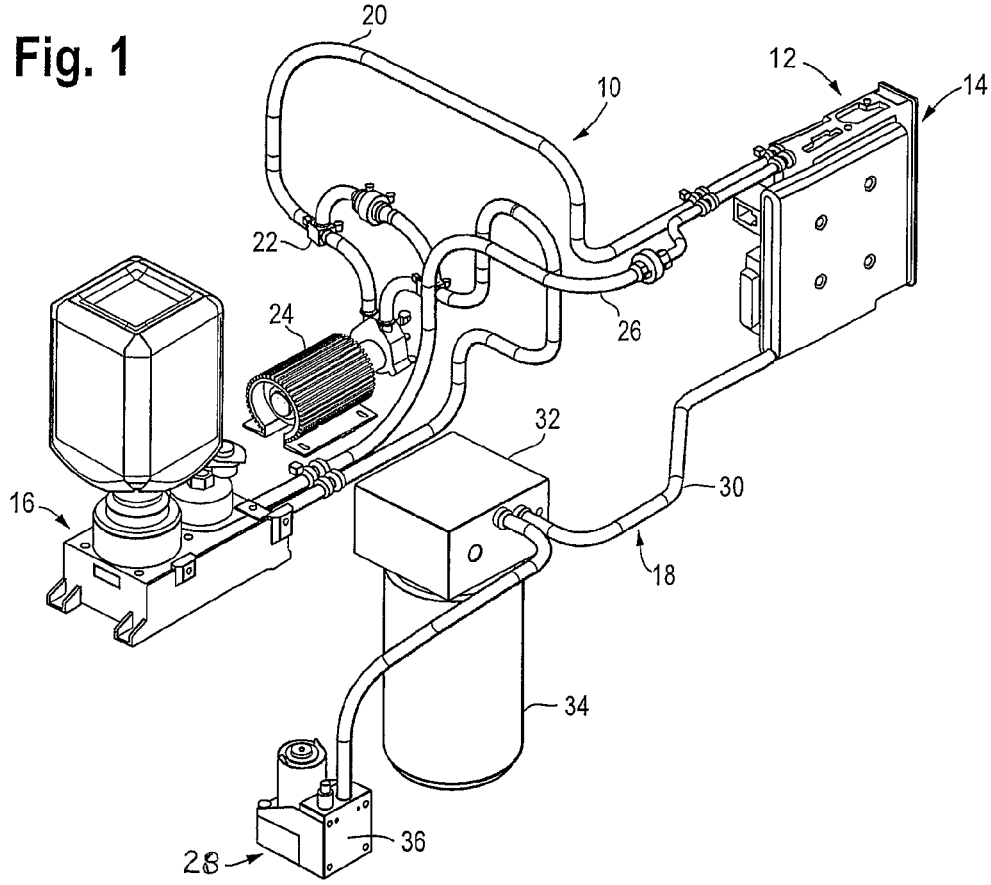
FIG. 1 is an illustration of a printing system having an inkjet printhead having a cover embodying the principles of the present invention

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be understood that the title of this section of this specification, namely, "Detailed Description Of The Invention", relates to a requirement of the United States Patent Office, and does not imply, nor should be inferred to limit the subject matter disclosed herein.

Referring now to the figures and in particular to FIG. 1, there is shown, schematically, an ink jet printing system 10 having a printhead 12 with a cover device 14 embodying the principles of the present invention. The printing system 10 includes, generally, the printhead 12, an ink supply 16 and a waste collection system 18. Lines (fluid conduits) 20 and valves 22 interconnect the various equipment items. The system 10 can also include a priming system 24, return lines 26 and a vacuum system 28 that draws and collects vapors from the waste collection system 18 for automatic maintenance functions.

Generally, in operation, ink is drawn from the ink supply 16 by virtue of capillary action that is created at the printhead 12 when ink is jetted from the head 12. Ink is carried by supply lines 20 from the supply 16 to the printhead 12.

Waste fluid from the printhead 12 is routed, by a waste collection line 30, from the head 12 to the waste collection system 18. The waste collection system 18 includes a vapor separator 32 and a waste chamber 34. Air and vapor from the separator 32 is drawn off by a vacuum pump 36 (which creates a negative pressure in the waste collection line 30). Waste fluid can include ink that may be contaminated with dust, maintenance fluids or other non-desired materials.

The printhead 12 can operate by thermal, piezo-electric, valve-based or other drive principles, all of which will be well understood by those skilled in the art. In any case, the printhead 12 has a face plate 40 that is mounted to the body 42 of the printhead 12. A plurality of jetting orifices 44 are formed in the faceplate 40 through which the ink is jetted. As set forth above, the ink can be driven using any of a number of technologies. For purposes of explanation, openings 46 in the faceplate 40 on either side of the orifices 44 accommodate fasteners (not shown) that secure the plate 40 to the body 42 of the printhead 12.

As will be appreciated, the orifices 44 are small openings through which the ink is jetted or expelled. Accordingly, the orifices 44 can become easily clogged if debris or contaminants (such as dust) come to rest on the faceplate 40. As such, waste fluid is drawn away from the plate 40 during maintenance operations.

It will also be appreciated that the problem of the orifices 44 becoming clogged is exacerbated when quick drying inks are used. Typically, quick drying inks include a solvent or carrier that is relatively volatile. This results in the liquid portion of the ink quickly evaporating after the ink has been jetted onto the object O to be printed (e.g., substrate). This also, however, can result in the liquid portion of the ink evaporating as the ink resides at the orifices 44. It will be appreciated that drying occurs over a continuum. That is, as the solvent or carrier begins to evaporate from the ink, the viscosity of the ink increases to a point at which the ink becomes semi-fluidic and then subsequently becomes "dry" or solid. The present cover 12 is intended to maintain the ink in a fluidic or semi-fluidic, functional state for extended periods.

In order to overcome the quick evaporation of the liquid, the present cover 14 resides over the orifices 44 when the printhead 12 is not in the jetting mode and opens or uncovers the orifices 44 when the printhead 12 is in the jetting mode. It will be appreciated that the rate at which the carrier or solvent evaporates from around the orifices 44 is related to, among other factors, the concentration of the carrier or solvent in the localized atmosphere around the orifices 44. If the atmosphere is "dry" or low in localized vapor concentration, the rate of evaporation increases. Conversely, when the localized atmosphere is high in carrier or solvent vapor concentration, the rate of evaporation decreases.

Accordingly, the present cover 14 resides over the orifices 44 when the printhead 12 is idle or not jetting and provides a localized environment E that is higher in vapor concentration than that of the surrounding environment A. The cover 14 is positioned over the orifices 44, but is not in contact with the faceplate 40 at the orifice edges 41. Rather, the cover 14 defines a gap (as indicated at 48 in FIG. 2B) between the inner surface 50 of the cover 14 and the faceplate 40. In that the cover 14 extends over all or substantially all of the orifices 44, the gap 48 provides a common or communal, localized, substantially closed environment E in which the concentration of vapors is kept at a higher level than the surrounding atmosphere A. The higher vapor concentration results in a reduced evaporation rate, which correlates to a reduced drying time and accordingly, enhanced ink (fluid) performance.

As seen in FIGS. 2B and 3A-H, the cover can be configured to slide parallel to the surface 52 of the face plate 40, to expose or cover the orifices 44. In a present configuration, the cover 14 is operably connected to the head 12, for example to a portion of a maintenance module faceplate 40, to move between the exposed and the covered positions. The maintenance module faceplate 40 can be, for example, such as that illustrated in Jackson, U.S. Pat. Nos. 6,406,125, 6,457,802 and 6,739,697, and/or Cahill, et al., U.S. Pat. Nos. 6,637,862, 6,935,721 and D477,358, all of which patents are commonly assigned with the present application and are incorporated herein by reference.

The cover 14 can be mounted to the printhead 12 by one or more living hinges 54. In a present embodiment, the hinges 54 also serve to provide an engaging region 56 for contact by the object O for movement of the cover 14. The hinges 54 include first and second rigid legs 58, 60 joined to one another by a flexible hinge portion 62. One of the legs 58 is mounted to the faceplate 40 (at about the leg free end 64) and the other leg 60 is mounted to the cover 14 (at about that leg's free end 66). The hinge element 62 is biased to draw the legs 58, 60 toward one another. Applying a force at about the hinge portion 62 urges the legs 58, 60 outward—that is to spread.

To facilitate sliding movement of the cover 14, the faceplate 40 can include overhanging portions or flanges 68 (or grooves in the side of the faceplate 40) and the cover 14 can include fingers 70 (that depend and extend inwardly of the cover body 72) that wrap around and over the flanges 68. This provides a way in which the cover 14 can be mounted to the faceplate 40 so as to maintain the vapor space or gap 48 for maintaining the higher vapor concentration while at the same time assuring that the cover 14 remains movably mounted to and spaced from the plate 40. As will be appreciated from the figures, the cover 12 does not extend beyond the faceplate 40 form factor—that is, it is within the outline of the faceplate and does not extend beyond the edge 43 of the plate 40.

Figure 2A:
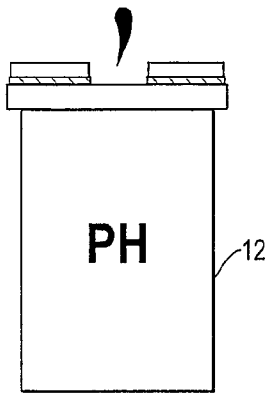
Figure 2B:
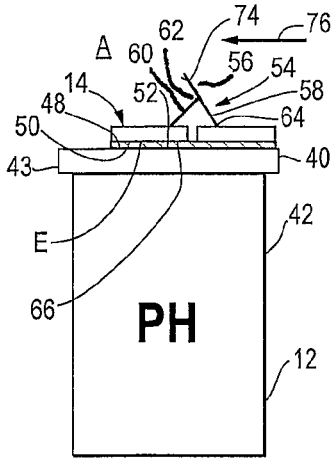
Figure 2C:
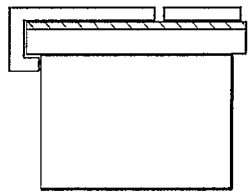

As seen in FIG. 2B, with the legs 58, 60 mounted to the faceplate 40 and the cover 14, and the hinge 54 in a relaxed or contracted state, the cover 14 overlies the orifices 44. The illustrated hinges 54 include an upwardly extending leg contact portion 74 that is an extension of the faceplate leg 58 beyond the hinge 62. The contact portion 74 provides a better transition for the movement of the cover leg 60.

As seen in FIGS. 3A-H, a box or other object O to be printed moves (as indicated by the arrow at 76) to the printhead 12, in close proximity to (e.g., a short transverse distance from) the faceplate 40. As the object O moves adjacent to the printhead 12 (FIG. 3C), the object O contacts the contact portion 74 of leg 58 and urges the hinge 62 toward the faceplate 40. Because the location of the free end 64 of the faceplate leg 58 is fixed, the free end 66 of the cover leg 60 moves which, in turn, forces the cover leg 60 to spread and the orifice cover 14 to open.

The contact portion 74 provides an accommodation for slight variations in the height or distance of the object O to be printed (e.g., the box) from the faceplate 40. The contact portion 74 provides an extended distance range over which the object O (such as a box) can be spaced from the faceplate 40 and actuate the hinge 54 without overstressing the legs 58, 60. It will be appreciated that if the object O were to contact too low on the leg 58, the hinge 54 could be overstressed, or if the object O was too high (too far from the printhead 12), the cover 14 might not open. Accordingly, the extended contact portion 74 provides a greater tolerance for object O distance from the printhead 12. In addition, the elongated contact surface 74 provides a smoother movement to the cover 14 as it opens. That is, the object O can "ramp up" the leg 58/74 to open the hinge 54 (and cover 14).

Figure 3A:
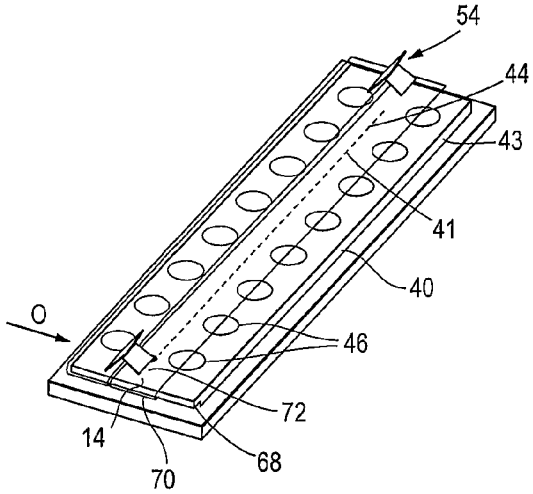
FIGS. 3A-H show, in sequence, the movement of the cover and the interaction with an object moving over the printhead.
Figure 3B:
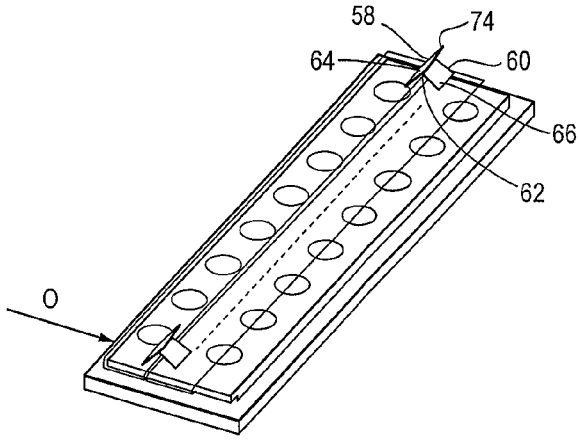
Figure 3C:
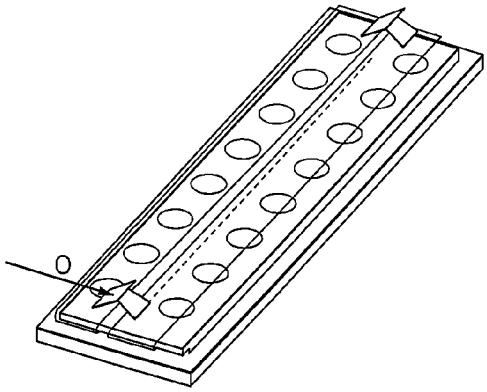
Figure 3D:
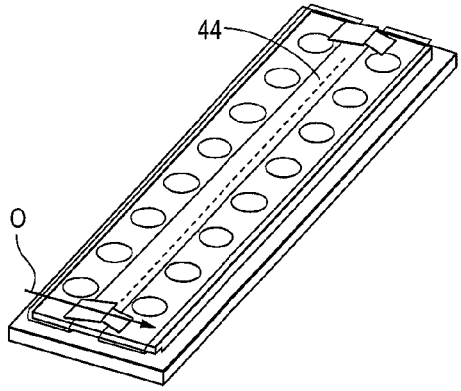
Figure 3E:
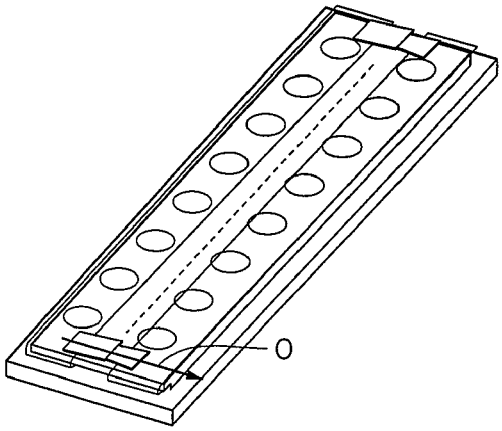
Figure 3F:
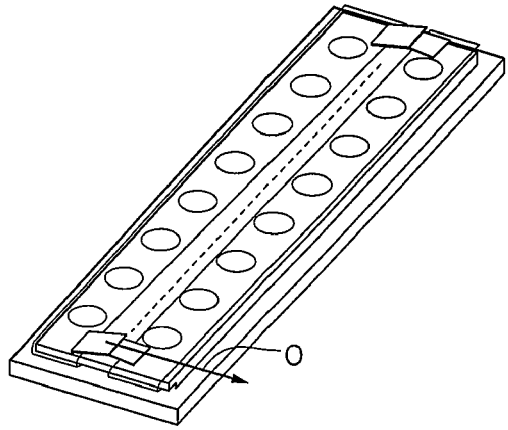
Figure 3G:
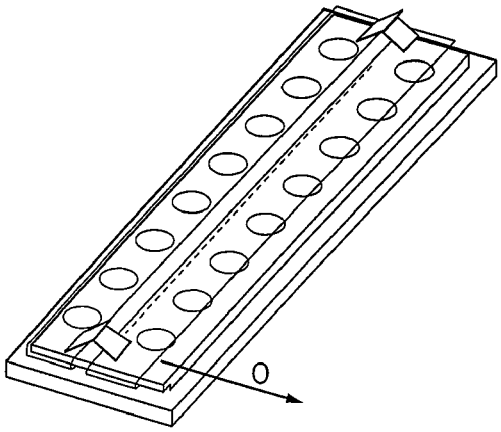
Figure 3H:
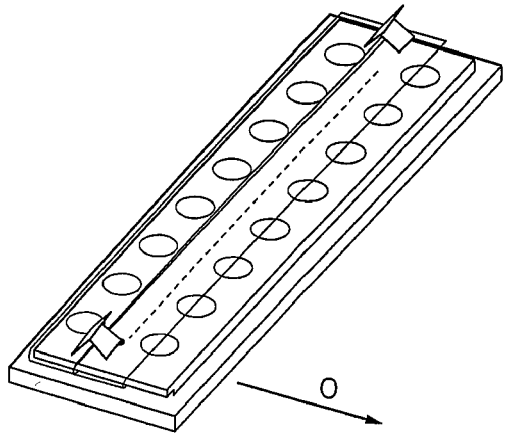

Referring to FIG. 3D, as the object O continues to move over the printhead 12 and urges the hinge 54 toward the printhead 12 (downward), the cover 14 continues to move until fully open (FIG. 3E). Once the object O passes over the cover 14 and the force (of the object O) on the hinge 54 is removed, the hinge 54 begins to return to the relaxed state and the cover 14 begins to close ((FIGS. 3F and 3G), until the cover 14 is fully closed (FIG. 3H). It will be understood by those skilled in the art that this is only one way in which the cover 14 can be opened. It is anticipated that electro-mechanical devices, such as solenoids and the like can also be used to effect movement of the cover 14. Such other arrangements and methods are within the scope and spirit of the present invention.

It will also be appreciated that the cover 14 provides a number of other advantages and enhancements. First, because the cover 14 is used in an in-line sense, that is with the printhead 12 in operation, it is possible to provide a means for clean "spitting". As will be understood, "spitting" or forced purging of the printhead 12 is occasionally carried out to clear the printhead 12. As can be imagined, without a cover 14, a forced purge could otherwise result in ink being ejected into areas in which it is undesirable. The cover 14 provides the ability to carry out this purge without unduly spreading ink into these areas. It is also possible to shut down equipment for short periods without the need for undue purging or other extended start-up procedures.

It will be understood by those skilled in the art that the cover 14 provides a communal or common environment E for all of the orifices 44 that are "under cover". It is the higher concentration of fluid vapors in the local environment E (relative to the surrounding atmosphere or environment A) that prevents evaporation of fluid at the orifices 44 and thus retards solidifying of the fluid. In that the cover 14 can be incorporated into the fluid jet maintenance module or faceplate 40, which, in turn, is in flow communication with the waste collection system 18, this provides an even greater volume for fluid/vapor interaction with the cover environment E (as through the collection line 30). It is also contemplated that the cover 12 can be configured to provide individual compartments for each of the orifices 44.

Figure 4:
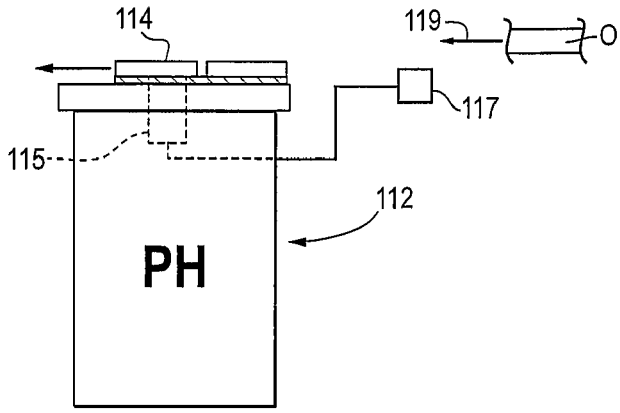
FIG. 4 is a graphic side view of an alternate embodiment of the printhead.

An alternate embodiment of the cover 114 is shown mounted to a printhead 112 in FIG. 4 in which the cover 114 is actuated by electro-mechanical means, such as a solenoid 115. The solenoid 115 can be mounted in a variety of locations and can actuated directly or indirectly (such as by a linkage, not shown). The solenoid can be actuated through the use of, for example, a proximity sensor 117 that is located near the printhead 112 that senses the presence of an object O moving toward the printhead 112 (as indicated by the arrow at 119).

The present cover 14 provides a host of advantages over known printhead systems. First, it enhances the performance of the ink (fluid) jetted from the printhead 12 in that it retards drying and solidifying at the printhead orifices 44. Such an enhancement also includes extending the life of the ink and reducing maintenance of printhead 12. In addition, in that the cover is used in-line, it has minimal or no adverse impact on the use of the printhead 12.

All patents referred to herein, are hereby incorporated by reference, whether or not specifically done so within the text of this disclosure.

In the disclosures, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover all such modifications as fall within the scope of the claims.

What is claimed is:

1. A cover for a fluid jet device having a surface defining at least one orifice formed therein through which a fluid is jetted, the cover comprising:

a movable cover element, the cover element movable parallel to the surface between a covered position in which the cover element overlies the at least one orifice and an uncovered position in which the cover is moved to expose the at least one orifice, the cover including a mounting portion configured to maintain the cover spaced from the surface to define a vapor space region; and at least one hinge element operably mounting the cover to the fluid jet device, the hinge element including a first leg mounted at a free end to a stationary portion of the fluid jet device and a second leg mounted at a free end to the cover portion, the first and second legs connected to one another by a flexible region such that movement of the legs slides the cover between the covered and exposed positions, wherein the vapor space region maintains a level of fluid vapor concentration around the orifices to reduce the rate of evaporation of the fluid.

2. The cover in accordance with claim 1 including at least two hinge elements.

3. The cover in accordance with claim 2 wherein the hinge elements are spaced from one another at about opposite ends of the cover element.

4. The cover in accordance with claim 1 wherein the first leg has an extension portion that extends beyond the hinge element.

5. The cover in accordance with claim 1 wherein the cover includes fingers depending from and extend inwardly of the cover element.

6. The cover in accordance with claim 1 wherein the cover does not extend beyond the form factor of the fluid jet device surface.

7. The cover in accordance with claim 1 wherein the flexible region is a living hinge.

8. A cover for a fluid jet device having a surface defining at least one orifice formed therein through which a fluid is jetted, the cover comprising:

a movable cover element, the cover element movable parallel to the surface between a covered position in which the cover element overlies the at least one orifice and an uncovered position in which the cover is moved to expose the at least one orifice, the cover including a mounting portion configured to maintain the cover spaced from the surface to define a vapor space region;

an electro-mechanical actuator operably connected to the cover element for moving the cover between the covered and uncovered positions; and an electronic sensor for detecting the presence or absence of an object and transmitting a signal to the actuator to move the cover to the covered or the uncovered position, wherein the vapor space region maintains a level of fluid vapor concentration around the orifices to reduce the rate of evaporation of the fluid.

9. The cover in accordance with claim 8 wherein the actuator is a solenoid.

10. A fluid jetting device especially for use with evaporative fluids, comprising:

a fluid jetting member having a faceplate thereon defining a surface, the surface defining a plurality of orifices therein through which the fluid is jetted; and a cover for the fluid jetting member, the cover having a cover element movable parallel to the surface between a covered position in which the cover element overlies the orifices and an uncovered position in which the cover is moved to expose the orifices, the cover including a mounting portion configured to maintain the cover spaced from the surface to define a vapor space region;

at least one hinge element operably mounting the cover to the fluid jetting device, the hinge element including a first leg mounted at a free end to a stationary portion of the fluid jetting device and a second leg mounted at a free end to the cover portion, the first and second legs connected to one another by a flexible region such that movement of the legs slides the cover between the covered and exposed positions, wherein the vapor space region maintains a level of fluid vapor concentration around the orifices to reduce the rate of evaporation of the fluid.

11. The fluid jetting device in accordance with claim 10 including at least a pair of hinge elements.

12. The fluid jetting device in accordance with claim 11 wherein the hinge elements are spaced from one another at about opposite ends of the cover element.

13. The fluid jetting device in accordance with claim 10 wherein the first leg has an extension portion that extends beyond the hinge element.

14. The fluid jetting device in accordance with claim 10 wherein the faceplate has overhanging edges on opposites sides thereof parallel to a direction of movement of the cover, and wherein the cover includes fingers depending from and extend inwardly of the cover element to wrap around the overhanging edges of, or in grooves in, the faceplate.

15. The cover in accordance with claim 10 wherein the cover does not extend beyond an edge of the faceplate.

16. The fluid jetting device in accordance with claim 10 wherein the flexible region is a living hinge.

17. The fluid jetting device in accordance with claim 10 wherein the faceplate is configured to be in flow communication with a waste collection system.

18. The fluid jetting device in accordance with claim 10 wherein the surface of the faceplate defines one or more openings to accommodate fasteners that secure the faceplate to the fluid jetting member.

19. A method for maintaining a fluid in a fluidic state at an orifice of a fluid jetting device comprising the steps of:

providing a fluid jet device having a plurality of orifices through which the fluid is jetted;

providing a movable cover overlying the orifices and mounted to the fluid jet device by at least one hinge element, wherein the at least one hinge element includes a first leg mounted to the fluid jet device and a second leg mounted to the cover, and wherein the first and second legs are joined to one another by a flexible hinge portion such that movement of the legs slides the cover to cover and expose the orifices;

moving the cover to expose the orifices when fluid is being jetted from the orifices; and moving the cover over the orifices when fluid is not being jetted from the orifices.

20. The method in accordance with claim 19 wherein the step of moving the cover is effected by the movement of an object over the fluid jetting device in proximity to the cover.

* * * * *